US006698915B2

(12) United States Patent
Dearing et al.

(10) Patent No.: US 6,698,915 B2
(45) Date of Patent: Mar. 2, 2004

(54) MANIFOLD FOR MIXING DEVICE

(75) Inventors: Michael P. Dearing, Cypress, TX (US); Scott A. Toler, Cypress, TX (US); Daniel R. King, Houston, TX (US)

(73) Assignee: Rolligon Corporation, Anderson, TX (US)

( * ) Notice: Subject to any disclaimer, the term of this patent is extended or adjusted under 35 U.S.C. 154(b) by 105 days.

(21) Appl. No.: 10/036,018

(22) Filed: Dec. 26, 2001

(65) Prior Publication Data

US 2003/0117890 A1 Jun. 26, 2003

(51) Int. Cl.[7] ..... B01F 15/02

(52) U.S. Cl. ..... 366/182.2; 137/597; 366/182.3; 366/182.4

(58) Field of Search ..... 166/280, 305.1, 166/308; 137/597; 366/165.5, 173.1, 181.6, 182.2, 182.3, 182.4

(56) References Cited

U.S. PATENT DOCUMENTS

| | | | | |
|---|---|---|---|---|
| 1,694,574 A | | 12/1928 | Witter et al. | |
| 3,563,475 A | | 2/1971 | Emery et al. | |
| 4,901,563 A | * | 2/1990 | Pearson | 73/152.31 |
| 6,095,429 A | | 8/2000 | Killgrove et al. | |

* cited by examiner

*Primary Examiner*—Terry K. Cecil
(74) *Attorney, Agent, or Firm*—G. Turner Moller

(57) ABSTRACT

A blender mixes a liquid and a quantity of particulate solids for use in hydrocarbon well operations. The blender is mounted on a vehicle having a suction manifold of rectangular tubing. The long side of the rectangular tubing is vertical, is positioned on one side of the vehicle and provides a large number of inlet connections which, in use, connect to hoses leading to tanks filled with a frac liquid or the like. The discharge manifold may be a mirror image of the suction manifold. The rectangular suction manifold tubing provides greater spacing between the inlet connections and greater volume throughput in use. Also, the rectangular suction manifold tubing is tilted so that the inlets are angled toward the ground.

18 Claims, 3 Drawing Sheets

MANIFOLD FOR MIXING DEVICE

This invention relates to an improved manifold for a mixing device and, more particularly, to an improved manifold for a blender used to produce a slurry.

BACKGROUND OF THE INVENTION

An important development in the production of oil and gas in recent decades, at least in the continental United States, has been the improvement of hydraulic fracturing techniques for stimulating production from previously uneconomically tight formations. For example, the largest gas field put on production in the lower forty eight states in the last twenty years is the Bob West Field in Zapata County, Tex. This field was discovered in the 1950's but was uneconomic using the fracturing techniques of the time where typical frac jobs comprised injecting 5,000–20,000 pounds of proppant into a well. It was not until the 1980's that large frac jobs became feasible where in excess of 300,000 pounds of proppant were routinely injected into wells. The production from wells in the Bob West Field increased from a few hundred MCF per day to tens of thousands of MCF per day. Without the development of high volume frac treatments, there would be very little deep gas produced in the Continental United States.

A blender, or blending unit, is an important piece of equipment in a large scale frac job because it produces the large quantity of slurry necessary, the slurry being a mixture of a liquid and the proppant. The liquid is typically water, although it is occasionally lease crude, diesel or other liquid, to which has been added chemicals to increase the capacity of the liquid to carry suspended solids. These chemicals are usually gelling agents that increase the viscosity of the water. The proppant used in frac jobs is normally sand of some type but is often a particulate material having more desirable properties, such as crush strength and the like. Thus, bauxite, alumina, carbo ceramics and other materials are often used.

Blenders are also useful in other operations, such as acid stimulation and water frac treatments which do not inject particulates into a well. In these situations, the blender is used for its ability to accept liquid from multiple sources and deliver it to multiple pump trucks.

All blenders are skid, truck or trailer mounted because the equipment is necessarily moved to each well site where the fracturing operation is conducted. In the United States, the maximum width of most blenders is accordingly dictated by highway regulations. Thus, without special permits to drive wide loads on highways, the maximum width of blenders is currently eight feet, six inches. Few service companies and few operators want a blender that is not driveable on paved roads without special permits because permits are time consuming and aggravating to obtain and sometimes emergencies require the blenders to move without prior notice.

Prior art blenders have a suction manifold providing a multiplicity of inlets for connection to one or more frac tanks holding the liquid, a hopper into which the proppant is delivered, a proppant metering system, a pump connected to the suction manifold and delivering liquid to one or more mixing chambers, a discharge pump and a discharge manifold for connection to one or more pump trucks which pump the slurry into the well. The suction and discharge manifolds have uniformly been round pipes, usually positioned on opposite sides of the blender vehicle.

Disclosures of general interest relative to this invention are found in U.S. Pat. Nos. 1,694,574; 3,563,475 and 6,095,429.

SUMMARY OF THE INVENTION

A blender of this invention provides an improved suction manifold providing lower pressure losses, less turbulence and higher throughputs than prior art suction manifolds. The same design may also be used for the discharge manifold.

The suction manifold comprises rectangular tubing having a length dimension preferably extending in the direction of travel of the trailer, truck or skid. The short dimension of the rectangular tubing is more-or-less horizontal, extending across the width of the blender vehicle providing a substantial space savings. The long dimension of the rectangular section is upright, i.e. more-or-less vertical.

Two additional important features are provided by a manifold design of this type. First, the vertical side of the rectangular tubing provides a large flat surface to which is welded a large number of flanges or other suitable inlet/outlet connections. It is much easier and less expensive to weld connections to a flat surface than to a circular one. This allows a large number of temporary conduits, such as flexible hoses, to connect to a large number of frac tanks or pump trucks while allowing the inlets and outlets to be spaced farther apart. This allows sufficient room around the inlets and inlet valves or outlets and outlet valves for connecting and disconnecting the hoses. More importantly, the throughput through the suction manifold of this invention is considerably greater than through a prior art suction manifold of a larger horizontal dimension.

It is an object of this invention to provide an improved manifold for a liquid mixing unit.

It is an object of this invention to provide a blender having an improved suction assembly.

Another object of this invention is to provide a blender having a suction manifold made from a length of rectilinear tubing.

A further object of this invention is to provide a blender having a discharge manifold made from a length of rectilinear tubing.

These and other objects of this invention will become more fully apparent as this description proceeds, reference being made to the accompanying drawings and appended claims.

DETAILED DESCRIPTION

Figure 1:
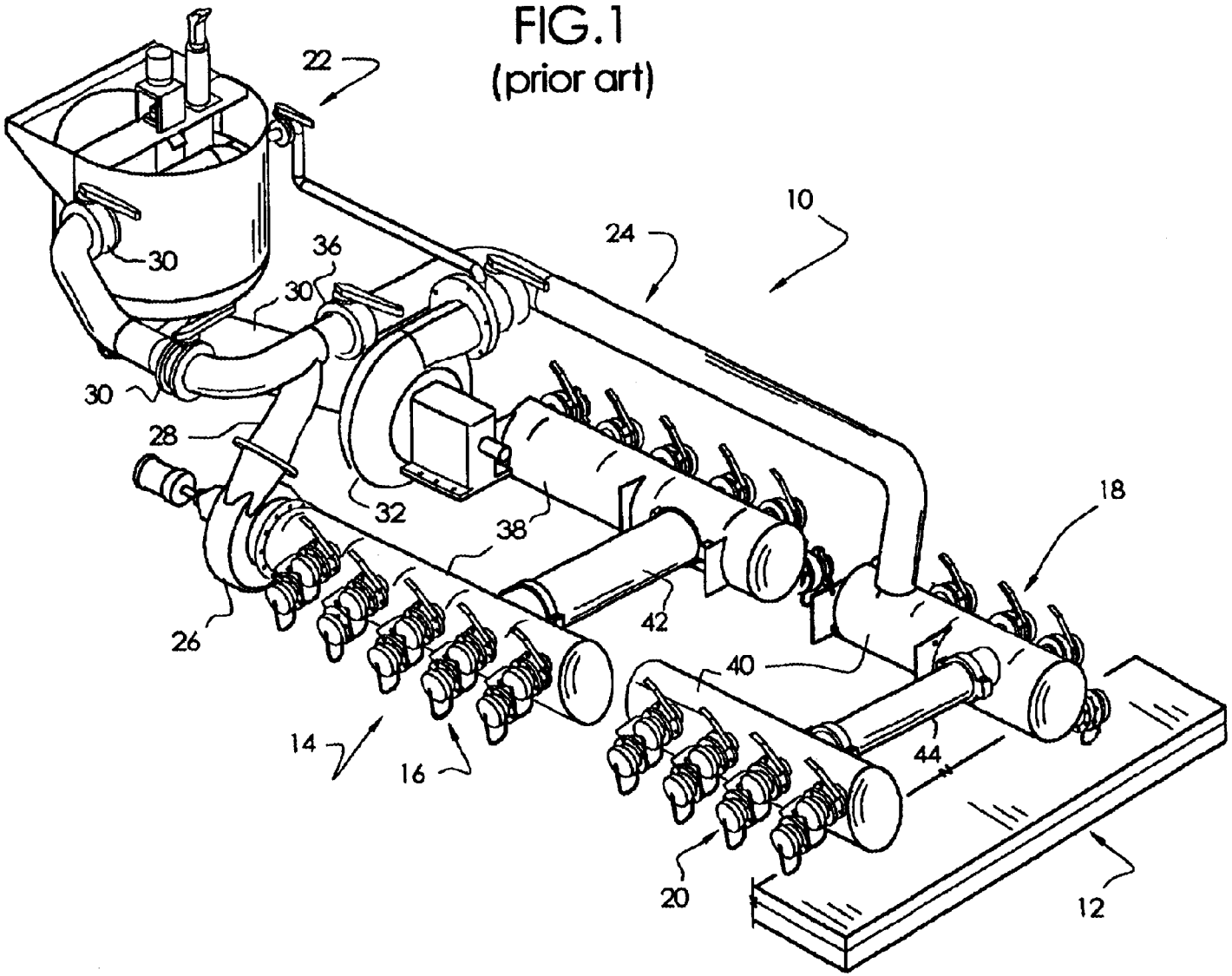
FIG. 1 (prior art)
FIG. 1 is a schematic view of a prior art blender.

Referring to FIG. 1, a prior art blender 10 comprises a wheeled vehicle 12 having a suction manifold 14 providing a large number of inlet connections 16, a discharge manifold 18 providing a large number of outlet connections 20, a mixing unit 22 for receiving a quantity of particulates from an elevating conveyor (not shown) or the like and delivering a slurry of liquid and particulates and a fluid path 24 connecting the suction manifold 14, the mixing unit 22 and the discharge manifold 18.

The fluid path 24 includes a pump 26 receiving liquid from the suction manifold 14 and delivering liquid to the mixing unit 22 through a conduit 28 having a series of normally open valves 30. The fluid path 24 also includes a pump 32 having an inlet conduit 34 receiving slurry from the bottom of the mixing unit 22 and a normally closed valve 36 selectively communicating with the conduit 28 for purposes more fully apparent hereinafter.

The suction and discharge manifolds 14, 18 provide round tubular bodies 36, 38 extending in the direction of forward travel of the vehicle 12 as shown by the arrow in FIG. 1. The tubular bodies 36, 38 are on opposite sides of the vehicle 12 with the connections 16, 20 pointing outwardly, away from the vehicle 12. A conduit 42 extends between the tubular bodies 38 to allow feeding of liquid from either or both sides of the blender vehicle 12. A similar conduit 44 between the tubular bodies 40 allows delivery of from either or both sides of the blender vehicle.

In use, hoses (not shown) connect the inlet connections 16 to a large number of tanks, known in the art as frac tanks, containing water or other frac liquid. Similar hoses connect the discharge connections 20 to a large number of pump trucks (not shown) which deliver the slurry under high pressure into a well. Suitable means (not shown), such as an elevating conveyor, is used to deliver the particulate solids to the mixing unit 22. The mixing unit 22 receives solids through its open top and liquid through the conduit 28, thoroughly mixes the solids and liquid to provide a slurry and delivers the slurry through the outlet conduit 34.

It will be apparent that the equipment necessary to conduct a frac job travel to and are assembled at a well site and conduct an operation by pumping a slurry into the well. At the end of the operation, the components are disassembled and leave the well site. Those skilled in the art will recognize the blender 10 as typical of prior art blending units used in fracing wells with high volumes of proppant. Those skilled in the art will also recognize that some prior art blenders use a single pump or other mechanism, often known as a slinger, to mix the liquid and proppant.

Figure 2:
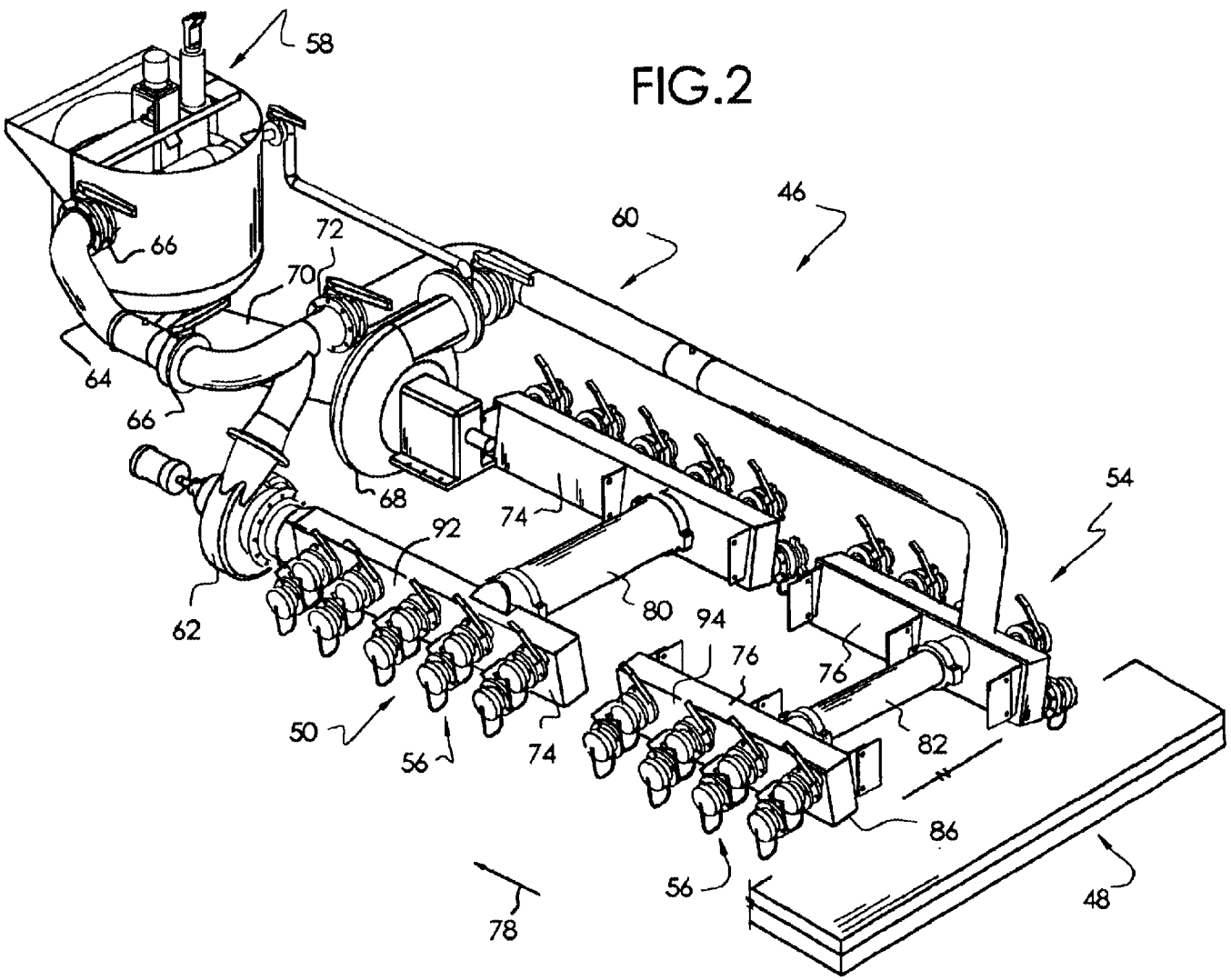
FIG. 2 is a similar schematic view of a blender of this invention.
Figure 3:
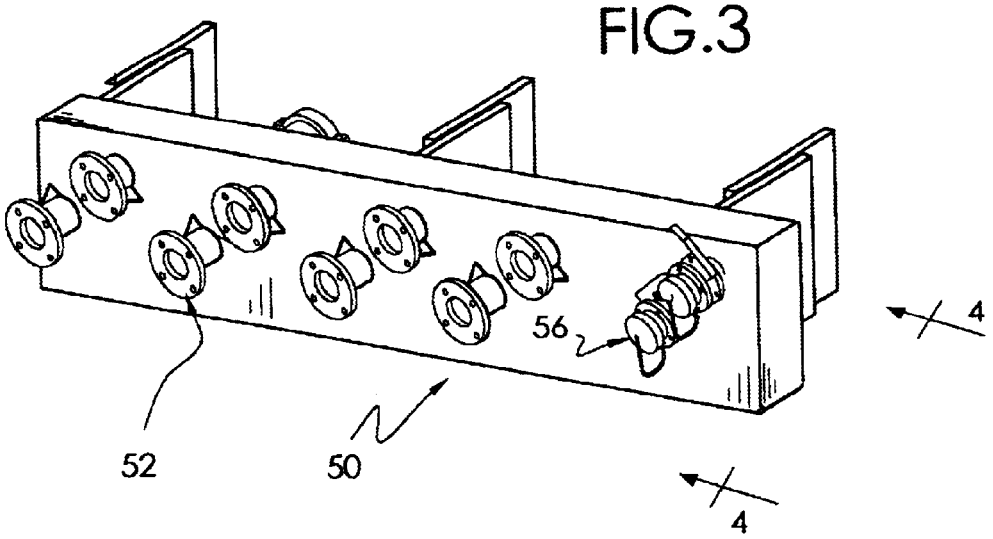
FIG. 3 is an enlarged isometric view of a suction manifold of this invention.
Figure 4:
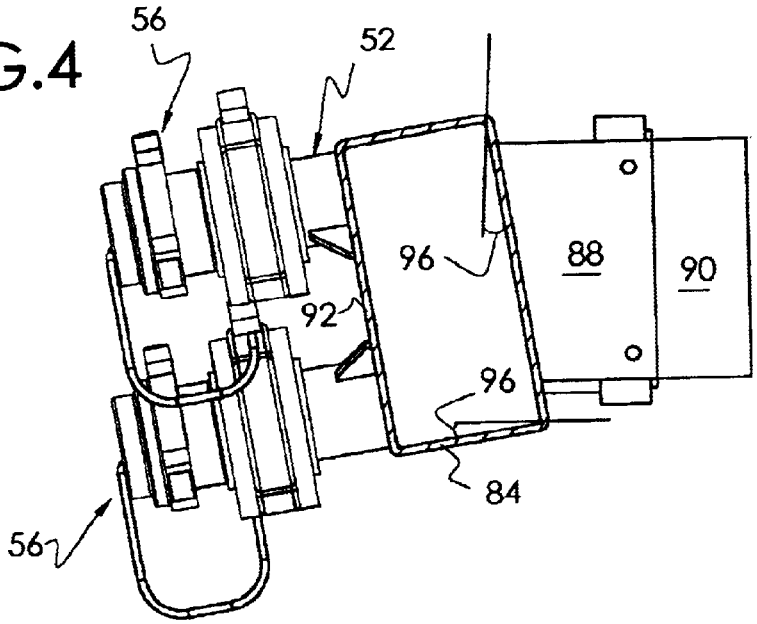
FIG. 4 is a cross-sectional view of the suction manifold of FIG. 3, taken along line 4—4 as viewed in the direction indicated by the arrows.

Referring to FIGS. 2–4, a blender 46 of this invention is organized in much the same manner as the prior art blender 10. The blender 46 is mounted on a chassis, which could be a skid mounted hauled on a separate truck, but which preferably is a wheeled vehicle 48, such as a truck or trailer, having a suction manifold 50 providing a large number of inlet connections 52 such as flanges or the like for receiving quick disconnect couplings 56, a discharge manifold 54 providing a large number of outlet connections having similar flanges for receiving quick disconnect couplings 56, a mixing unit 58 for receiving a quantity of particulates from an elevating conveyor (not shown) or the like and delivering a slurry of liquid and particulates and a fluid path 60 connecting the suction manifold 50, the mixing unit 58 and the discharge manifold 54.

The fluid path 60 includes a pump 62 receiving liquid from the suction manifold 50 and delivering liquid to the mixing unit 58 through a conduit 64 having a series of normally open valves 66. The fluid path 60 also includes a pump 68 having an inlet conduit 70 receiving slurry from the bottom of the mixing unit 58 and a normally closed valve 72 selectively communicating with the conduit 64 for purposes more fully apparent hereinafter.

The suction and discharge manifolds 50, 54 each provide a pair of rectilinear tubular bodies 74, 76 extending in the direction of forward travel 78 of the vehicle 48 and are connected by a conduit 80, 82. The rectilinear bodies 74, 76 are on opposite sides of the vehicle 48 with the connections 52, pointing outwardly, away from the vehicle 48. The tubular bodies 74, 76 accordingly provide bottom walls 84, 86 extending across the width of the vehicle 48, i.e. transverse to the direction of travel 78. The tubular bodies 74, 76 are mounted by suitable brackets 88 to suitable struts 90 on the body of the vehicle 48 in any suitable manner.

The tubular bodies 74, 76 provide upright side walls 92, 94 adjacent the sides of the vehicle 48. Because the walls 92, 94 are essentially flat, welding the connections 52 is simplified, as compared to welding a connection to a round tube. More importantly, there is a larger area on the side walls 92, 94, when compared to the area of a round tube, thereby allowing the connections 52 to be spaced further apart. This makes it considerably easier to remove the plugs from the quick disconnect couplings 56 and secure hoses (not shown) having quick disconnect connections and the like to the couplings 56 to thereby connect the suction and discharge manifolds 50, 54 to frac tanks and pump trucks.

As shown best in FIG. 4, the tubular bodies 74, 76 are tilted slightly in an outboard direction, i.e. the upper end of the bodies 74, 76 is slightly outward of the lower end by an angle 96 which is typically 3–20 ° and preferably about 5–10° from a line perpendicular to the horizontal platform of the chassis. This is done so the hoses (not shown) attached to the couplings 56 are aimed slightly toward the ground. The hoses used in frac operations are typically wire reinforced hoses which do not kink readily but tilting the upper end of the bodies 74, 76 reduces the stress applied to the hoses and thereby prolongs their useful life. Often, hoses used in frac operations are replaced when they begin to kink near the connection with the manifolds.

The rectilinear tubular bodies 74, 76 are preferably rectangular with the long dimension upright as shown best in FIG. 4. This provides a large surface for the connections 52 and, even more importantly, the suction manifold 50 provides increased throughput compared to the prior art manifold 14 of the same horizontal dimension. It will be realized that prior art manifolds 14 using 12" O.D. pipe and the associated connections consume more than 25% of the usable 8'6" width dimension of the vehicle 12. A typical suction manifold of this invention is 8"×16" which provides about 13% greater flow area than a 12" O.D. round tube. A typical suction manifold 50 thus consumes less of the usable 8'6" dimension of the vehicle 48 and provides substantially increased flow area. This increased flow area, as well as reduced flow turbulence, provides substantially greater throughput.

Tests have been conducted on prior art blenders having inlet manifolds made from 12" O.D. tubes and on blenders of this invention made from 8"×16" rectangular tubes, all other equipment being identical. The throughput of the prior art blender with standard test equipment was 97 barrels per minute. The throughput of the blender of this invention with standard test equipment was 106 barrels per minute. This is an increase of 9% utilizing 8" less horizontal space. On a vehicle having a maximum width of 8' 6", a reduction in the width of a component by 8" provides space for additional components. Throughput is primarily affected because with a 16" inlet spacing, the central flow path on a 12" diameter pump is not disturbed by the flow from the inlets.

The connections 40, 44 may be of any suitable type and are illustrated as flanges connecting to quick disconnect type couplings such as hammer unions.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

We claim:

1. A blender for preparing a treatment liquid, comprising a chassis providing a generally horizontal platform;

a manifold having a length of tubing supported by the chassis, the tubing having an upright generally planar side wall and a multiplicity of inlet connections opening through the upright side wall, the upright wall including an upper edge and a lower edge, the upper edge being outboard of the lower edge so the upright wall defines an angle, with a line perpendicular to the horizontal platform, in the range of 3–20°; and a fluid path including the manifold providing a mechanism for adding another material to the fluid path.

2. The blender of claim 1 wherein the mechanism comprises an inlet and an outlet and the manifold is a suction manifold connected to an inlet of the mechanism and further comprising a discharge manifold in communication with the mechanism outlet.

3. The blender of claim 2 wherein the upright side wall of the suction manifold faces away from the chassis and the discharge manifold comprises a length of tubing providing a transverse bottom wall and an upright side wall facing away from the chassis and a multiplicity of outlet connections opening through the discharge manifold upright side wall.

4. The blender of claim 3 wherein the suction manifold tubing and the discharge manifold tubing are rectangular in cross-section.

5. The blender of claim 4 wherein the chassis provides a direction of travel, the suction and discharge manifold tubing extending in the direction of travel.

6. The blender of claim 5 wherein the first mentioned length of tubing of the suction manifold extends along a first side of the chassis in the direction of travel and the suction manifold further comprises a second length of rectangular tubing extending in the direction of travel along a second side of the chassis, the second rectangular tubing having an upright generally planar side wall facing away from the chassis and a multiplicity of inlet connections opening through the upright side wall and further comprising a conduit connecting the rectangular tubing lengths of the suction manifold.

7. The blender of claim 6 wherein the first mentioned length of tubing of the discharge manifold extends along a first side of the chassis in the direction of travel and the suction manifold further comprises a second length of rectangular tubing extending in the direction of travel along a second side of the chassis, the second discharge manifold rectangular tubing having an upright generally planar side wall facing away from the chassis and a multiplicity of inlet connections opening through the second discharge manifold upright side wall and further comprising a conduit connecting the rectangular tubing lengths of the discharge manifold.

8. The blender of claim 2 wherein the mechanism for adding another material to the fluid path comprises a first pump having a suction in communication with the suction manifold and a discharge, an open top hopper for receiving particulate solids and liquid from the first pump discharge, and a second pump for receiving a mixture of solids and liquid from the hopper and delivering the mixture to the discharge manifold.

9. The blender of claim 1 wherein the upright side wall has a height dimension and further comprising a transverse bottom wall generally perpendicular to the upright side wall and having a width dimension, the height dimension being greater than the width dimension.

10. The blender of claim 9 wherein the manifold tubing is rectangular in cross-section.

11. The blender of claim 1 wherein the chassis provides a direction of travel, the first mentioned length of tubing is rectangular in cross-section and extends along the direction of travel along one side of the chassis and the manifold comprises a second length of rectangular tubing extending in the direction of travel along a second side of the chassis, the second rectangular tubing having an upright generally planar side wall facing away from the chassis and a multiplicity of inlet connections opening through the upright side wall and further comprising a conduit connecting the rectangular tubing lengths of the manifold.

12. The blender of claim 1 wherein the angle is 5–10°.

13. A blender for preparing a treatment liquid, comprising:

a wheeled chassis having a direction of travel and providing a generally horizontal platform;

a suction manifold having a length of rectangular tubing extending in the direction of travel along a side of the chassis, the tubing having an upright generally planar side wall facing away from the chassis and a multiplicity of inlet connections opening through the upright side wall; the upright wall including an upper edge and a lower edge, the upper edge being outboard of the lower edge so the upright wall defines an angle, with a line perpendicular to the horizontal platform, in tho range of 3–20°;

a discharge manifold having a length of tubing extending in the direction of travel along a side of the chassis providing a multiplicity of outlet connections; and a fluid path connecting the inlet and outlet manifolds including an open top hopper for receiving particulate solids and a mechanism for mixing solids from the hopper with liquid from the suction manifold and delivering a slurry to the discharge manifold.

14. The manifold of claim 13, wherein the suction manifold comprises a second length of rectangular tubing extending in the direction of travel along an opposite side of the chassis, the second rectangular tubing having an upright generally planar side wall facing away from the chassis and a multiplicity of inlet connections opening through the upright side wall and further comprising a conduit connecting the rectangular tubing lengths of the suction manifold.

15. The blender of claim 13 wherein the angle is 5–10°.

16. The blender of claim 13 wherein the discharge manifold comprises a second length of rectangular tubing extending in the direction of travel along an opposite side of the chassis, the second rectangular tubing having a second upright generally planar side wall facing away from the chassis and a multiplicity of inlet connections opening through the second upright side wall and further comprising a conduit connecting the rectangular tubing lengths of the discharge manifold.

17. The blender of claim 16 wherein the second upright wall of the discharge manifold tubing includes an upper edge and a lower edge, the upper edge being outboard of the lower edge so the upright wall defines an angle, with a line perpendicular to the horizontal platform, in the range of 3–20°.

18. The blender of claim 17 wherein the angle between the vertical and the upright wall of the discharge manifold tubing lengths is 5–10°.

* * * * *